US008940100B2

(12) United States Patent
Yoneda et al.

(10) Patent No.: US 8,940,100 B2
(45) Date of Patent: Jan. 27, 2015

(54) METHOD FOR CLEANING HOT DIP GALVANIZED STEEL SHEET AND CLEANING APPARATUS THEREFOR

(75) Inventors: Satoshi Yoneda, Chiba (JP); Takahiro Sugano, Chiba (JP)

(73) Assignee: JFE Steel Corporation, Tokyo (JP)

( * ) Notice: Subject to any disclaimer, the term of this patent is extended or adjusted under 35 U.S.C. 154(b) by 631 days.

(21) Appl. No.: 12/086,438

(22) PCT Filed: Jan. 22, 2007

(86) PCT No.: PCT/JP2007/051321

§ 371 (c)(1), (2), (4) Date: Jun. 12, 2008

(87) PCT Pub. No.: WO2007/086533

PCT Pub. Date: Aug. 2, 2007

(65) Prior Publication Data

US 2009/0283110 A1 Nov. 19, 2009

(30) Foreign Application Priority Data

Jan. 26, 2006 (JP) ..... 2006 017745

(51) Int. Cl.
*C23G 1/00* (2006.01)
*B08B 3/02* (2006.01)
(Continued)

(52) U.S. Cl.
CPC . *B08B 3/022* (2013.01); *C23G 1/02* (2013.01); *C23G 3/023* (2013.01)
USPC ..... 134/15; 134/10; 134/26; 134/32

(58) Field of Classification Search
CPC ..... C23G 1/08; C23G 1/19; C23G 3/02; C23G 3/023; C23G 3/026; C23G 3/029; B08B 3/041
USPC ..... 134/26, 28, 38, 41, 42
See application file for complete search history.

(56) References Cited

U.S. PATENT DOCUMENTS 2,359,088 A * 9/1944 Croft ..... 134/9
3,491,778 A * 1/1970 Gopon et al. ..... 134/64 R
(Continued)

FOREIGN PATENT DOCUMENTS

DE 1 225 943 9/1966
EP 0 601 991 A1 6/1994
(Continued)

OTHER PUBLICATIONS

Machine Translation: JP2002-256448 to Gama et al. Sep. 2002.*
(Continued)

*Primary Examiner* — Michael Kornakov
*Assistant Examiner* — Natasha Campbell
(74) *Attorney, Agent, or Firm* — Holtz, Holtz, Goodman & Chick PC

(57) ABSTRACT

Cleaning of a hot dip galvanized steel sheet is conducted by bringing a strip-shaped steel sheet which was treated by surface oxidation in advance into contact with a cleaning liquid for 1 second or more, and then bringing the hot dip galvanized steel sheet into contact with pure water, while continuously transferring the hot dip galvanized steel sheet. The method allows efficiently and fully washing off the acidic solution adhered to the surfaces of the hot dip galvanized steel sheet treated by surface oxidation. The invention also provides an apparatus for cleaning the hot dip galvanized steel sheet to carry out the above cleaning method.

8 Claims, 4 Drawing Sheets

(51) Int. Cl.

| | |
|---|---|
| ***B08B 3/04*** | (2006.01) |
| ***B08B 3/08*** | (2006.01) |
| ***C23G 1/02*** | (2006.01) |
| ***C23G 3/02*** | (2006.01) |

(56) References Cited

U.S. PATENT DOCUMENTS

| | | | | |
|---|---|---|---|---|
| 3,938,214 | A | 2/1976 | Hodsden et al. | |
| 6,372,706 | B1 * | 4/2002 | Boulos | 510/420 |
| 2004/0134523 | A1 | 7/2004 | Budry, Jr. et al. | |
| 2004/0226579 | A1 * | 11/2004 | Starcevic et al. | 134/15 |

FOREIGN PATENT DOCUMENTS

| | | | |
|---|---|---|---|
| JP | 63-108742 | A | 5/1988 |
| JP | 2002-256448 | A | 9/2002 |
| JP | 2002-292347 | A | 10/2002 |
| JP | 2003--96584 | A | 4/2003 |
| JP | 2003-306781 | A | 10/2003 |

OTHER PUBLICATIONS

Supplementary Partial European Search Report and Communication dated Dec. 4, 2009 for European Patent Application 07707552.1.

* cited by examiner

METHOD FOR CLEANING HOT DIP GALVANIZED STEEL SHEET AND CLEANING APPARATUS THEREFOR

This application is the United States national phase application of International Application PCT/JP2007/051321 filed Jan. 22, 2007.

TECHNICAL FIELD

The present invention relates to a method and an apparatus for cleaning a steel sheet which was prepared by hot dip galvanizing on a strip-shaped steel sheet, and by applying alloying and temper rolling, further by applying surface oxidation using an acidic solution, (hereinafter referred to as "the hot dip galvanized steel sheet").

BACKGROUND ART

On applying hot dip galvanization to a strip-shaped steel sheet, the steel sheet which was treated by pickling for descaling, followed by rolling in a rolling mill to a specified thickness is annealed in an annealing furnace, and further is transferred to a molten zinc bath. FIG. 3 illustrates the process of common hot dip galvanizing line on and after the molten zinc bath. The steel sheet travels in the arrow "a" direction.

For applying hot dip galvanization to a steel sheet 1*a*, the steel sheet 1*a* is immersed in a molten zinc bath 2, as illustrated in FIG. 3. Zinc in molten state is held in the molten zinc bath 2, (hereinafter referred to as "the zinc bath"). During the travel of the steel sheet 1*a* in the zinc bath, zinc adheres to both surfaces of the steel sheet 1*a*.

Then, the steel sheet 1*a* is sent from the molten zinc bath 2 to an alloying furnace 3, where the steel sheet 1*a* is subjected to alloying treatment. The alloying treatment is a heat treatment to enhance the alloying reaction between the steel base material of the steel sheet 1*a* and the zinc adhered to the steel sheet 1*a*, thus forming a zinc-plating layer having excellent adhesion.

The steel sheet 1*a* after leaving the alloying furnace 3 is cooled before an interim looper 4 while being adjusted in the tension thereon, and is further sent to a temper rolling mill 5 to undergo temper rolling (what is called the "skin pass"). The temper rolling is a rolling to apply a light reduction of about 0.6 to about 3% of reduction in thickness to deform only in the vicinity of the surface of steel sheet 1*a*, thereby adjusting the surface properties (such as surface roughness) of the steel sheet 1*a*. The reduction in thickness is defined by the value derived from eq. (1):

$$\text{Reduction in thickness (\%)}=100\times(t_1-t_2)/t_1 \quad (1)$$

where, $t_1$ is the thickness before temper rolling (mm), and $t_2$ is the thickness after temper rolling (mm).

Then, the steel sheet 1*a* is fed from the temper rolling mill 5 to a surface oxidation apparatus 6 to receive surface oxidation treatment. The surface oxidation treatment is given to bring both surfaces of the steel sheet 1*a* into contact with an acidic solution, thus to form an oxide film on the surface of the plating layer. The steel sheet which was treated by the surface oxidation is hereinafter referred to as "the hot dip galvanized steel sheet 1*b*".

With thus covering the plating layer with the oxide film, the sliding property of the hot dip galvanized steel sheet 1*b* on working (for example on press-forming) into products having varieties of shapes is improved. Since, however, the hot dip galvanized steel sheet 1*b* which is processed from the surface oxidation apparatus 6 has acidic solution adhered thereto, both surfaces of the hot dip galvanized steel sheet 1*b* are cleaned in a rinse tank 7 by washing off the acidic solution, and the hot dip galvanized steel sheet 1*b* is further dried in a drier 8.

The cleaned hot dip galvanized steel sheet 1*b* enters an outlet looper 9, where the tension thereon is adjusted, and enters an oiler 10, where a rust-preventive is applied onto the surfaces thereof, followed by coiling the hot dip galvanized steel sheet 1*b* by a coiler 11.

As of the conventional hot dip galvanizing line described above, FIG. 4 shows a part-enlarged view ranging from the surface oxidation apparatus 6 to the rinse tank 7. The hot dip galvanized steel sheet travels in the arrow "a" direction.

The surface oxidation apparatus 6 brings the surface of the hot dip galvanizing on the steel sheet 1*a* into contact with the acidic solution. As shown in FIG. 4, for example, acidic solution spray nozzles 12 to spray the acidic solution 13 are arranged therein.

The hot dip galvanized steel sheet 1*b* on which the acidic solution was sprayed in the surface oxidation apparatus 6 is sent to the rinse tank 7. To assure a period of time necessary to form the oxide film on the surface of the plating layer at a sufficient thickness, the distance between the surface oxidation apparatus 6 and the rinse tank 7 is determined to a specific length. For example, by controlling the traveling period of time between the surface oxidation apparatus 6 and the rinse tank 7, the thickness of the oxide film can reach to 10 μm (nanometer) or larger. Japanese Patent Laid-Open Nos. 2002-256448 and 2003-306781 disclose that the covering a plating layer with an oxide film having 10 μm or larger thickness improves the sliding property of hot dip galvanized steel sheet 1*b*, thus preventing damages and peeling of plating layer on working (press-forming and the like) into products having varieties of shapes.

The rinse tank 7 arranges nozzles therein to spray a cleaning water 14. By spraying the cleaning water 14 to the hot dip galvanized steel sheet 1*b*, the acidic solution adhered to the hot dip galvanized steel sheet 1*b* is removed. Sole spraying of the cleaning water 14 is, however, difficult to completely wash off the acidic solution adhered to the hot dip galvanized steel sheet 1*b*. Although investigations about the issue are given including addition of chemicals to the cleaning water 14, there are left improvement issues in terms of composition and adding amount of chemicals.

Remained acidic solution on the surface of the hot dip galvanized steel sheet 1*b* leads to corrosion of the plating layer by acid, which results in not only the deterioration of appearance but also the damages and peeling of plating layer, thereby decreasing the product yield.

An object of the present invention is to solve the above problems and to provide a cleaning method and a cleaning apparatus to efficiently and fully wash off the acidic solution adhered to the surface of a hot dip galvanized steel sheet which was treated by surface oxidation.

DISCLOSURE OF THE INVENTION

The present invention provides a method for cleaning hot dip galvanized steel sheet by steps of bringing a strip-shaped hot dip galvanized steel sheet, treated by surface oxidation in advance, into contact with a cleaning liquid for 1 second or more, and then bringing the hot dip galvanized steel sheet into contact with pure water, while continuously transferring the hot dip galvanized steel sheet.

According to the cleaning method of the present invention, the contact with the cleaning liquid and the contact with the pure water are preferably conducted in a single cleaning tank.

Furthermore, it is preferable that a diluted cleaning liquid prepared by mixing the cleaning liquid with the pure water in the single cleaning tank is stored in a circulation tank, and that the hot dip galvanized steel sheet is further brought into contact with the diluted cleaning liquid in the circulation tank, while utilizing the diluted cleaning liquid by recirculating thereof. In addition, it is more preferable that the contact of the diluted cleaning liquid is given at a position after a position of beginning the contact with the cleaning liquid and at a position before a position of beginning the contact with the pure water.

For any of the above cleaning methods, the cleaning liquid preferably contains P, and specifically the P concentration in the cleaning liquid is preferably in a range from 4 to 70 ppm by mass.

The present invention provides an apparatus for cleaning hot dip galvanized steel sheet, which has: cleaning liquid spray nozzles which spray a cleaning liquid to both surfaces of a strip-shaped hot dip galvanized steel sheet which was treated by surface oxidation and which is continuously traveling; and pure water spray nozzles which spray pure water to both surfaces of the hot dip galvanized steel sheet at a position where the hot dip galvanized steel sheet travels 1 second or more after being sprayed with the cleaning liquid.

The apparatus of the present invention preferably has an inverting roller to invert a traveling direction of the hot dip galvanized steel sheet, at a position between the spraying position of the cleaning liquid spray nozzles and the spraying position of the pure water spray nozzles.

Both of above apparatuses preferably arrange both the cleaning liquid spray nozzles and the pure water spray nozzles in a single cleaning tank.

Any of the above apparatuses preferably further has a circulation tank which stores a diluted cleaning liquid prepared by mixing the cleaning liquid with the pure water in the single cleaning tank, and diluted cleaning liquid spray nozzles which spray the diluted cleaning liquid in the circulation tank to both surfaces of the hot dip galvanized steel sheet. For these apparatuses, it is preferable that the diluted cleaning liquid spray nozzles are located between a spraying position of the cleaning liquid spray nozzles and a spraying position of the pure water spray nozzles.

The present invention provides a method for cleaning strip-shaped hot dip galvanized steel sheet while continuously transferring a strip-shaped hot dip galvanized steel sheet which was treated by surface oxidation, which method has steps of: bringing the hot dip galvanized steel sheet into contact with a cleaning liquid for 1 second or more; and then bringing the hot dip galvanized steel sheet into contact with pure water.

BEST MODE FOR CARRYING OUT THE INVENTION

Figure 1:
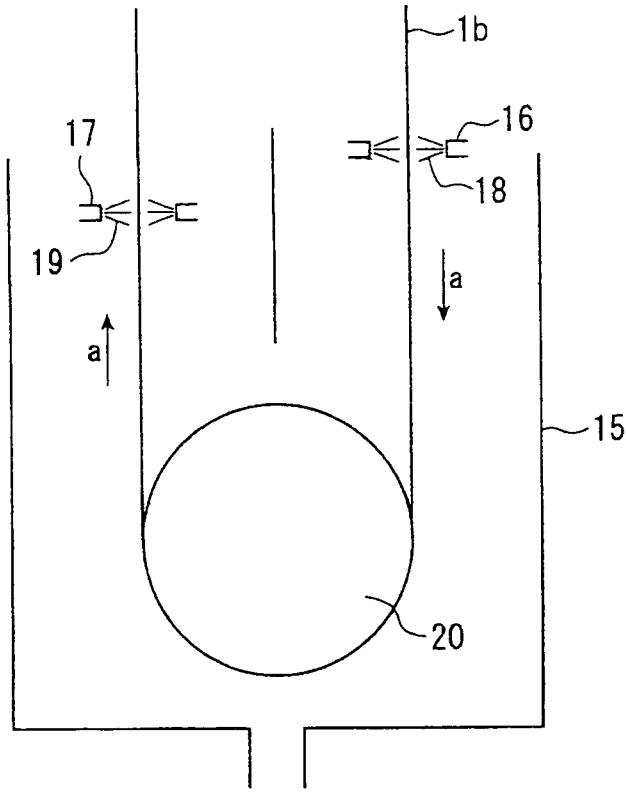
FIG. 1 illustrates a cross sectional view of an example of the cleaning apparatus according to the present invention.

FIG. 1 illustrates a cross sectional view of an example of the cleaning apparatus according to the present invention. According to the present invention, it is possible that the tank where the cleaning liquid is sprayed and the tank where the pure water is sprayed are separately installed to conduct cleaning of a hot dip galvanized steel sheet. The embodiment described herein adopts an example of illustration in FIG. 1, where the spray of cleaning liquid and the spray of pure water are given in a single tank, (hereinafter referred to as "the cleaning tank"). The hot dip galvanized steel sheet 1*b* travels in the arrow "a" direction.

The hot dip galvanized steel sheet 1*b* prepared by hot dip galvanizing on a strip-shaped steel sheet 1*a*, by applying treatment of alloying and temper rolling, followed by surface oxidation using an acidic solution is sent to a cleaning tank 15. The cleaning tank 15 has cleaning liquid spray nozzles 16 and pure water spray nozzles 17. The pure water nozzles 17 are located at a position where the hot dip galvanized steel sheet travels 1 second or more after being sprayed with the cleaning liquid. The cleaning liquid spray nozzles 16 spray a cleaning liquid 18 having cleaning function to both surfaces of the hot dip galvanized steel sheet 1*b*, and the pure water spray nozzles 17 spray pure water to both surfaces of the hot dip galvanized steel sheet 1*b*. The pure water in the present invention is distilled water, ion-exchanged water, industrial clean water, and the like, which are free from P.

The cleaning tank 15 preferably has an inverting roller 20 which inverts the travel direction of the hot dip galvanized steel sheet 1*b*. The inverting roller 20 inverts the traveling direction of the hot dip galvanized steel sheet 1*b*, (in the direction from bottom to top in the cleaning tank 15), after the cleaning liquid 18 is sprayed to the hot dip galvanized steel sheet 1*b* traveling from top to bottom of the cleaning tank 15, thereby allowing the cleaning liquid 18 at the lowermost position, (hereinafter referred to as "the inverting bottom end"), to drip from the hot dip galvanized steel sheet 1*b*. Accordingly, the hot dip galvanized steel sheet 1*b* keeps contact with the cleaning liquid 18 during a traveling period of from the spray of the cleaning liquid 18 to the dripping.

According to the present invention, it is preferable that the center axes of the opposing cleaning liquid spray nozzles 16, (hereinafter referred to as "the cleaning liquid spray position"), are aligned, and that the inverting roller 20 is located at a position assuring 1 second or more of the time for traveling the hot dip galvanized steel sheet 1*b* from the cleaning liquid spray position to the inverting bottom end, thereby ensuring 1 second or longer time of contacting the hot dip galvanized steel sheet 1*b* with the cleaning liquid 18. If the contact time is 1 second or more, the cleaning effect of the cleaning liquid 18 is fully attained.

It is preferable that the period of time for the hot dip galvanized steel sheet 1*b* to travel from the cleaning liquid spray position to the inverting bottom end, (or the time contacting with the cleaning liquid 18), is 10 seconds or less. If the above time becomes excessively large, a long cleaning tank 15 is required, and the cleaning liquid 18 dries on the surface of the hot dip galvanized steel sheet 1*b* to deposit the cleaning liquid ingredients, which deteriorates the appearance of the hot dip galvanized steel sheet 1*b*.

By limiting the time of contacting the hot dip galvanized steel sheet 1*b* with the cleaning liquid 18 to 1 second or more, preferably from 1.5 to 8 seconds, the concentration of the cleaning liquid 18 can be decreased, and the acidic solution adhered to the hot dip galvanized steel sheet 1*b* can be washed off.

The kind of the cleaning liquid 18 is not specifically limited if only it has the cleaning performance. It is, however, preferable that the cleaning liquid 18 contains an alkaline ingredient to neutralize and wash off the acidic solution adhered to the hot dip galvanized steel sheet 1*b*, and specifically preferred cleaning liquid 18 is the one containing P. For the cleaning liquid 18 containing P, a preferable concentration of P in the cleaning liquid 18 is from 4 to 70 ppm by mass. If the P concentration is 4 ppm by mass or more, the acidic solution adhered to the hot dip galvanized steel sheet 1*b* can be fully washed off. The P concentration of 70 ppm by mass or less considerably reduces the remaining amount of the cleaning liquid ingredients even after the pure water spray 19 described later, and the appearance of the hot dip galvanized steel sheet 1*b* is not deteriorated.

After the hot dip galvanized steel sheet 1*b* is brought into contact with the cleaning liquid 18, and further drips the cleaning liquid 18 therefrom at the inverting bottom end, the hot dip galvanized steel sheet 1*b* is brought into contact with the pure water 19 to remove the remained cleaning liquid 18.

According to the present invention, although the center axes of the opposing pure water spray nozzles 17, (hereinafter referred to as "the pure water spray position"), are aligned, the period of time for traveling the hot dip galvanized steel sheet 1*b* from the inverting bottom end to the pure water spray position is not specifically limited. It is, however, preferable that the position of the pure water spray is determined considering that the pure water 18 is sprayed before the cleaning liquid 18 remained on the hot dip galvanized steel sheet 1*b* is dried.

The cleaning liquid 18 and the pure water 19, sprayed to the hot dip galvanized steel sheet 1*b* in the cleaning tank 15 drop onto the bottom of the cleaning tank 15, which are then successively discharged to enter a separately installed tank, (hereinafter referred to as "the circulation tank"). That is, the cleaning liquid 18 and the pure water 19 are not held in the cleaning tank 15 but are held in the circulation tank as a mixture of cleaning liquid 18 diluted by pure water 19, (hereinafter referred to as "the diluted cleaning liquid"). If the diluted cleaning liquid is subjected to wastewater treatment to remove toxic substances before discharging, the enviroμment is not polluted.

Figure 2:
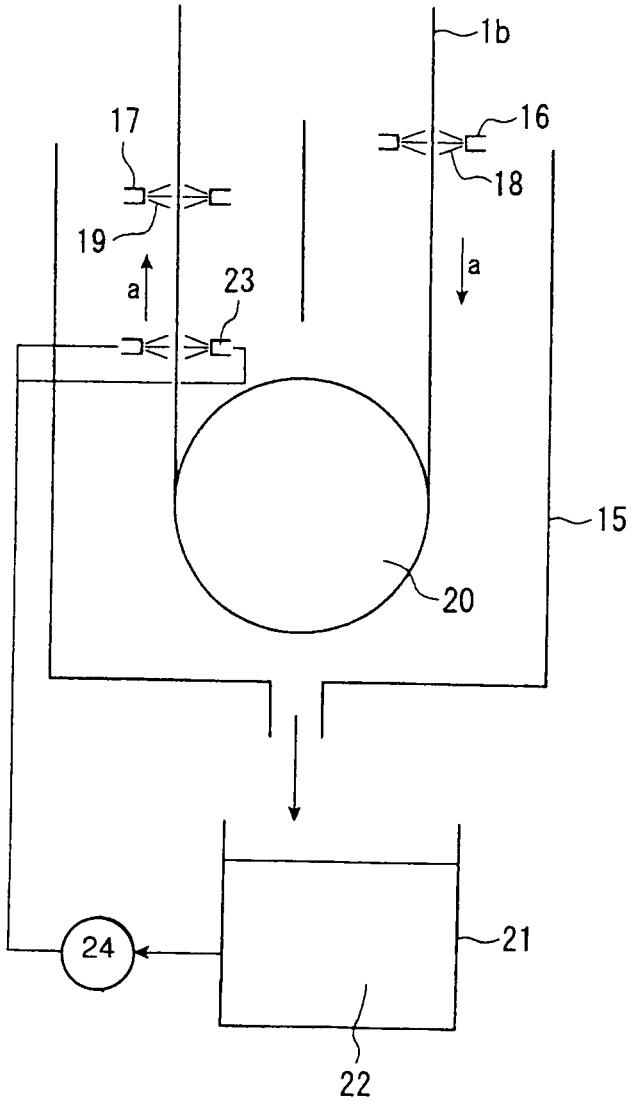
FIG. 2 illustrates a cross sectional view of another example of the cleaning apparatus according to the present invention.

Furthermore, the inventors of the present invention derived a finding that, on washing off the acidic solution adhered to the hot dip galvanized steel sheet 1*b*, the reuse of the diluted cleaning solution improves the cleaning effect. An example of the cleaning apparatus is illustrated in FIG. 2. The hot dip galvanized steel sheet travels in the arrow "a" direction.

As illustrated in FIG. 2, as an example, the diluted cleaning liquid 22 held in the circulation tank 21 is recirculated by a pump 24 or the like, and is further sprayed on both surfaces of the hot dip galvanized steel sheet 1*b* at an interim position between the position for initiating the contact with the cleaning liquid and the position for initiating the contact with the pure water, thus increases the cleaning effect. That is, adding to the cleaning liquid ingredients existing in the cleaning liquid 18, the low concentration cleaning liquid ingredients existing in the diluted cleaning liquid 22 are utilized to wash off the acidic solution adhered to the hot dip galvanized steel sheet 1*b*. At the cleaning step, the diluted cleaning liquid spray nozzles 23 spraying the diluted cleaning liquid 22 are arranged to align their center axes at their opposing positions, (hereinafter referred to as "the diluted cleaning liquid spray position").

The diluted cleaning liquid spray position is preferably located between the position for spraying the cleaning liquid and the position for spraying the pure water, and specifically preferable position is between the reverting bottom end and the pure water spray position because the spray of the diluted cleaning liquid 22 after dripping the cleaning liquid 18 effectively performs the cleaning effect of the cleaning liquid ingredients.

EXAMPLES

Figure 3:
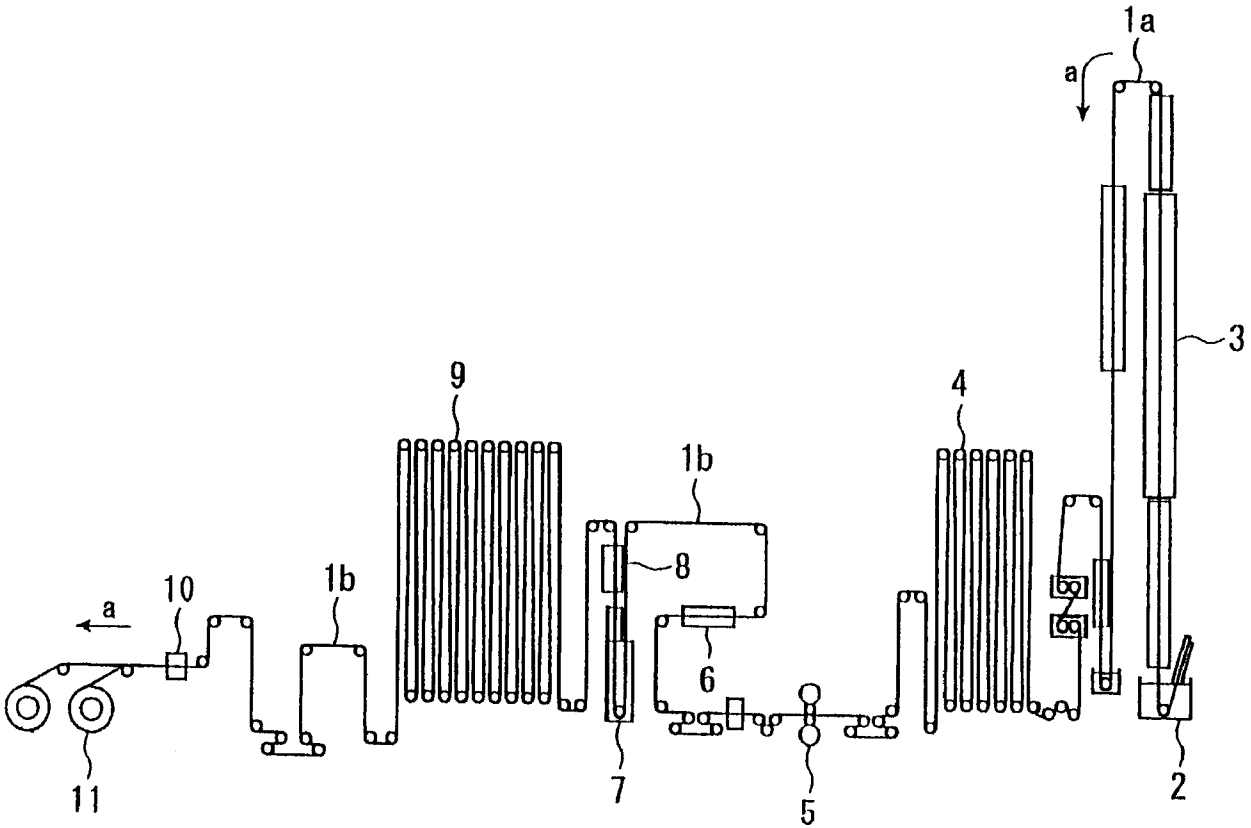
Fig. 3 PRIOR ART
FIG. 3 illustrates an arrangement of an example of hot dip galvanizing apparatus.
Figure 4:
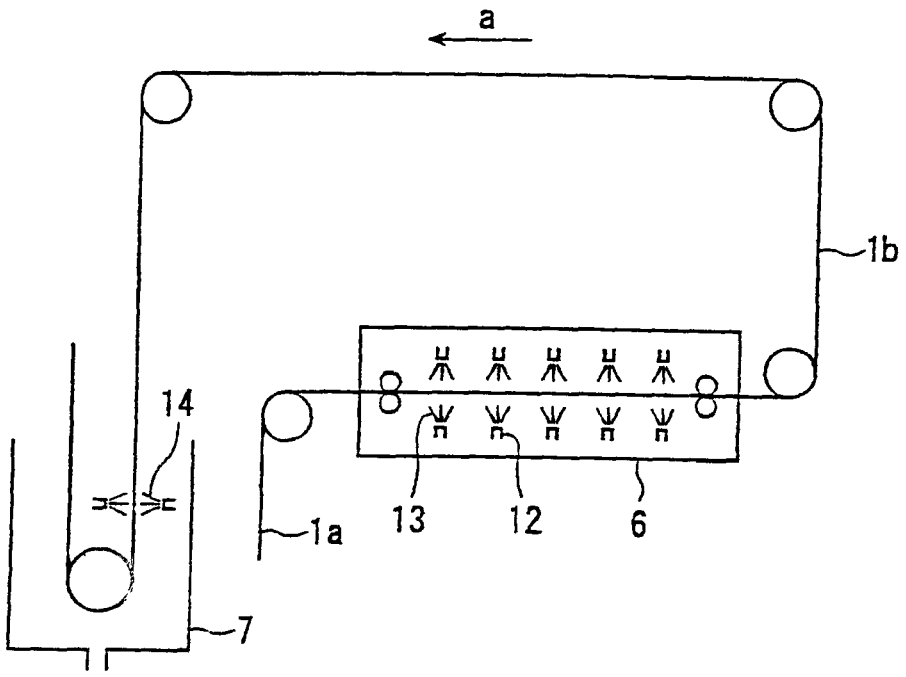
Fig. 4 PRIOR ART
FIG. 4 illustrates a part of conventional process ranging from the surface oxidation apparatus 6 to the cleaning tank 7.

The hot dip galvanized steel sheet 1*b* was prepared by installing the cleaning tank 15 shown in FIG. 1 instead of the rinse tank 7 in the hot dip galvanization line shown in FIG. 3. The inverting roller 20 in the cleaning tank 15 was located so as the hot dip galvanized steel sheet 1*b* to take 2.5 seconds of travel from the cleaning liquid spray position to the inverting bottom end. The cleaning liquid 18 contained P at a P concentration of 14 ppm by mass, an injection pressure of 0.15 MPa, and a flow rate of 5 $m^3$/hr. The pure water 19 was industrial clean water which was sprayed at a position so as the hot dip galvanized steel sheet 1*b* to take 2.5 seconds of travel from the inverting bottom end to the pure water spray position at an injection pressure of 0.15 MPa and a flow rate of 10 $m^3$/hr. The example was named the Example 1 of the Invention.

The hot dip galvanized steel sheet 1*b* was prepared by installing the cleaning tank 15 shown in FIG. 2 instead of the rinse tank 7 in the hot dip galvanization line shown in FIG. 3. The positions of the inverting roller 20, the cleaning liquid spray nozzles 16, and the pure water spray nozzles 17 in the cleaning tank 15, and the conditions for spraying the cleaning liquid and the pure water were the same to those in the Example 1, so that their descriptions are not given. The diluted cleaning liquid 22 was sprayed so as the hot dip galvanized steel sheet 1*b* to take 2.1 second of travel from the inverting bottom end to the diluted cleaning liquid spray position at an injection pressure of 0.20 MPa and a flow rate of 20 $m^3$/hr. The example was named the Example 2 of the Invention.

Conventionally the hot dip galvanized steel sheet 1*b* was manufactured by using the rinse tank 7 in the hot dip galvanizing line given in FIG. 3. The rinse tank 7 used industrial clean water as the cleaning water 14 at an injection pressure of 0.10 MPa and a flow rate of 10 $m^3$/hr. The example was named the Conventional Example.

For each of the Examples 1 and 2 of the Invention and the Conventional Example, the cleaned state on the hot dip galvanized steel sheet 1*b* was determined. The water-wetting rate calculated from eq. (2) was adopted as an index of the cleaned state. Higher value of water-wetting rate (%) indicates better cleaning result.

$$\text{Water-wetting rate (\%)} = [\text{Water-wetting surface area (mm}^2)]/[\text{Sample surface area (mm}^2)] \quad (2)$$

The water-wetting rate is defined by the following. A rust preventive (Nox-Rust 550 KH, manufactured by Nihon Parkerizing Co., Ltd.) was applied onto a sample, after cleaning, at a rate of 1900 mg/$m^2$. The sample was then immersed in a degreasing liquid (FC-E2011, manufactured by Nihon Parkerizing Co., Ltd.) for 2 minutes. Further the sample was cleaned by pure water. Then, the area rate of the water-wetted portion was determined by visual observation, which area rate is adopted as the water-wetting rate.

The observation gave the water-wetting rate of 80% for the Example 1 of the Invention, 85% for the Example 2 of the Invention, while giving 70% for the Conventional Example.

Industrial Applicability

The present invention allows efficiently and fully washing off the acidic solution adhered to the surface of the hot dip galvanized steel sheet after treating by the surface oxidation, thus the present invention contributes to the industries.

The invention claimed is:

1. A method for cleaning a hot dip galvanized steel sheet comprising the steps of:

continuously transferring a strip-shaped hot dip galvanized steel sheet, treated by a surface oxidation;

spraying a cleaning liquid to the hot dip galvanized steel sheet in a first cleaning step;

contacting the hot dip galvanized steel sheet with the cleaning liquid for 1 second or more;

spraying a diluted cleaning liquid to the hot dip galvanized steel sheet in a second cleaning step;

spraying a pure water to the hot dip galvanized steel sheet in a third cleaning step;

discharging the cleaning liquid and the pure water, sprayed to the hot dip galvanized steel sheet, to form a diluted cleaning liquid of the cleaning liquid diluted by the pure water in a discharging step;

circulating the diluted cleaning liquid from the discharging step to the second cleaning step; and providing an inverting roller for inverting a traveling direction of the hot dip galvanized steel sheet 180° from a first upside location to a downside location in a vertical direction and then from the downside location to a second upside location in a vertical direction, so that the traveling direction of the hot dip galvanized steel begins at the first cleaning step and terminates at the third cleaning step, thereby allowing the cleaning liquid to drip from the hot dip galvanized steel sheet at a lowermost bottom position of the inverting roller;

wherein the diluted cleaning liquid is sprayed onto the hot dip galvanized sheet after the inverting of the hot dip galvanized steel sheet, at a position between the first cleaning step and the third cleaning step, and wherein the second cleaning step and the third cleaning step are continuously performed at the second upside location.

2. The method for cleaning a hot dip galvanized steel sheet according to claim 1, wherein the first cleaning step, the second cleaning step and the third cleaning step are carried out in a cleaning tank.

3. The method for cleaning a hot dip galvanized steel sheet according to claim 1, wherein the first cleaning step, the second cleaning step and the third cleaning step are carried out in a cleaning tank;

the discharging step comprises discharging the cleaning liquid and the pure water, sprayed to the hot dip galvanized steel sheet, to mix the cleaning liquid with the pure water in said cleaning tank to form a diluted cleaning liquid of the cleaning liquid diluted by the pure water; and storing the diluted cleaning liquid in a circulation tank.

4. The method for cleaning a hot dip galvanized steel sheet according to claim 1, wherein the second cleaning step is carried out between the first cleaning step and the third cleaning step.

5. The method for cleaning a hot dip galvanized steel sheet according to claim 1, wherein the surface oxidation is carried out with an acidic solution, and the cleaning liquid contains an alkaline ingredient which neutralizes and washes off the acidic solution which adheres to the hot dip galvanized steel sheet.

6. The method for cleaning a hot dip galvanized steel sheet according to claim 1, wherein the surface oxidation is carried out with an acidic solution, and the cleaning liquid is a cleaning liquid that neutralizes and washes off the acidic solution which adheres to the hot dip galvanized steel sheet.

7. The method for cleaning a hot dip galvanized steel sheet according to claim 1, wherein the pure water is selected from the group consisting of distilled water, ion-exchanged water and industrial clean water.

8. The method for cleaning a hot dip galvanized steel sheet according to claim 1, wherein the contacting of the hot dip galvanized steel sheet with the cleaning liquid is carried out for 1.5 seconds or more to 8 seconds.

* * * * *

UNITED STATES PATENT AND TRADEMARK OFFICE

CERTIFICATE OF CORRECTION

PATENT NO. : 8,940,100 B2
APPLICATION NO. : 12/086438
DATED : January 27, 2015
INVENTOR(S) : Satoshi Yoneda et al.

It is certified that error appears in the above-identified patent and that said Letters Patent is hereby corrected as shown below:

In the Claims

Column 8, Claim 8, Line 4, after "1.5 seconds" delete "or more".

Signed and Sealed this
Twenty-first Day of July, 2015

Michelle K. Lee

Michelle K. Lee
*Director of the United States Patent and Trademark Office*